US005822923A

United States Patent [19]

Governale

[11] Patent Number: 5,822,923

[45] Date of Patent: Oct. 20, 1998

[54] DOOR WITH SWINGING SIDE LIGHT PANEL

[75] Inventor: Bernard Governale, Duluth, Ga.

[73] Assignee: Caradon Doors & Windows Group, Norcross, Ga.

[21] Appl. No.: 775,582

[22] Filed: Dec. 31, 1996

[51] Int. Cl.[6] ..... E06B 5/00

[52] U.S. Cl. ..... 49/365; 49/367

[58] Field of Search ..... 49/366, 367, 368, 49/371, 365; 52/204.51

[56] References Cited

U.S. PATENT DOCUMENTS

| | | | |
|---|---|---|---|
| 1,500,171 | 7/1924 | West | 49/366 |
| 1,925,817 | 9/1933 | Plym | 49/366 X |
| 2,007,808 | 7/1935 | McElroy . | |
| 2,101,803 | 12/1937 | Ames . | |
| 3,813,836 | 6/1974 | Dielman . | |
| 3,919,808 | 11/1975 | Simmons | 49/367 |
| 4,052,819 | 10/1977 | Beischel et al. | 49/368 |
| 4,573,287 | 3/1986 | Hagemeyer et al. | 49/366 X |
| 4,644,696 | 2/1987 | Bursk . | |
| 5,022,206 | 6/1991 | Schield et al. . | |
| 5,255,952 | 10/1993 | Ehrlich . | |
| 5,319,882 | 6/1994 | Biebuyck . | |

*Primary Examiner*—Jerry Redman
*Attorney, Agent, or Firm*—Shoemaker and Mattare, Ltd.

[57] ABSTRACT

A door assembly includes a conventional swinging door which closes against a side light panel that is normally locked in place and effectively forms part of the jamb. The side light panel is, however, mounted on hinges so that it can swing open when unlocked, to provide a temporary wide entryway to permit the passage of large items such as furniture.

4 Claims, 4 Drawing Sheets

DOOR WITH SWINGING SIDE LIGHT PANEL

BACKGROUND OF THE INVENTION

This invention relates to doors and more particularly to a door assembly having a swinging side light panel for increasing the effective width of the door.

A number of prefabricated door assemblies are provided with one or two side light panels having windows. The side lights are fixtures, being immovably attached to the door frame. They limit the width of items which can be moved through the door, even though the framing opening for the door assembly is much wider.

Prior inventors have proposed doors having means to temporarily increase the width of the certain door openings when large items have to pass through it. For example, U.S. Pat. No. 3,813,836 discloses a toilet compartment for the handicapped, including an auxiliary door about half the width of the main door to increase the size of the opening. U.S. Pat. No. 4,644,696 describes a patio door having a removable astragal (center post) between two doors, so that the full width of the opening can be used when needed. U.S. Pat. No. 5,255,952 describes an articulated van door structure.

It is impractical, and ordinarily unnecessary, to make entry doors for homes much wider than about three feet. The weight of the door increases at least directly with the width, and forces on the hinges increase at a greater rate. Large inswinging doors are heavier, sweep a larger volume inside the house, and allow greater volumes of conditioned air to escape each time they are opened. But it is convenient to have a large door opening when moving large objects into or out of the house. The best solution would be to have a door which had moderate width normally, but which could be expanded to a great effective width on occasion.

SUMMARY OF THE INVENTION

An object of the invention is to increase the potential width of a door opening, in an attractive and secure construction having a conventional appearance.

This and other objects are attained by a door and side light assembly comprising a frame providing a top jamb, a hinge jamb, a door having a hinged edge adjacent the hinge jamb, and a free edge, a side light adjacent the door. The side light has a molding member forming an astragal against which the free edge of the door closes when the side light is closed, means for latching the door to the molding member, and means for locking the side light closed against the door frame. The side light, hinged to swing about is edge opposite the free edge, may be opened to increase the effective width of the door opening when needed.

Other than being adapted to open an close, the side light is conventional in appearance, lacking any handle, and in most cases will have a number of transparent panes. Opaque panels would satisfy the intended function of this invention, however.

BRIEF DESCRIPTION OF THE DRAWINGS

In the accompanying drawings,

FIGS. 2, 3, 6 and 7 are not to scale, the views being foreshortened lengthwise so that the panels appear thicker than they actually are.

DESCRIPTION OF THE PREFERRED EMBODIMENT

Figure 1:
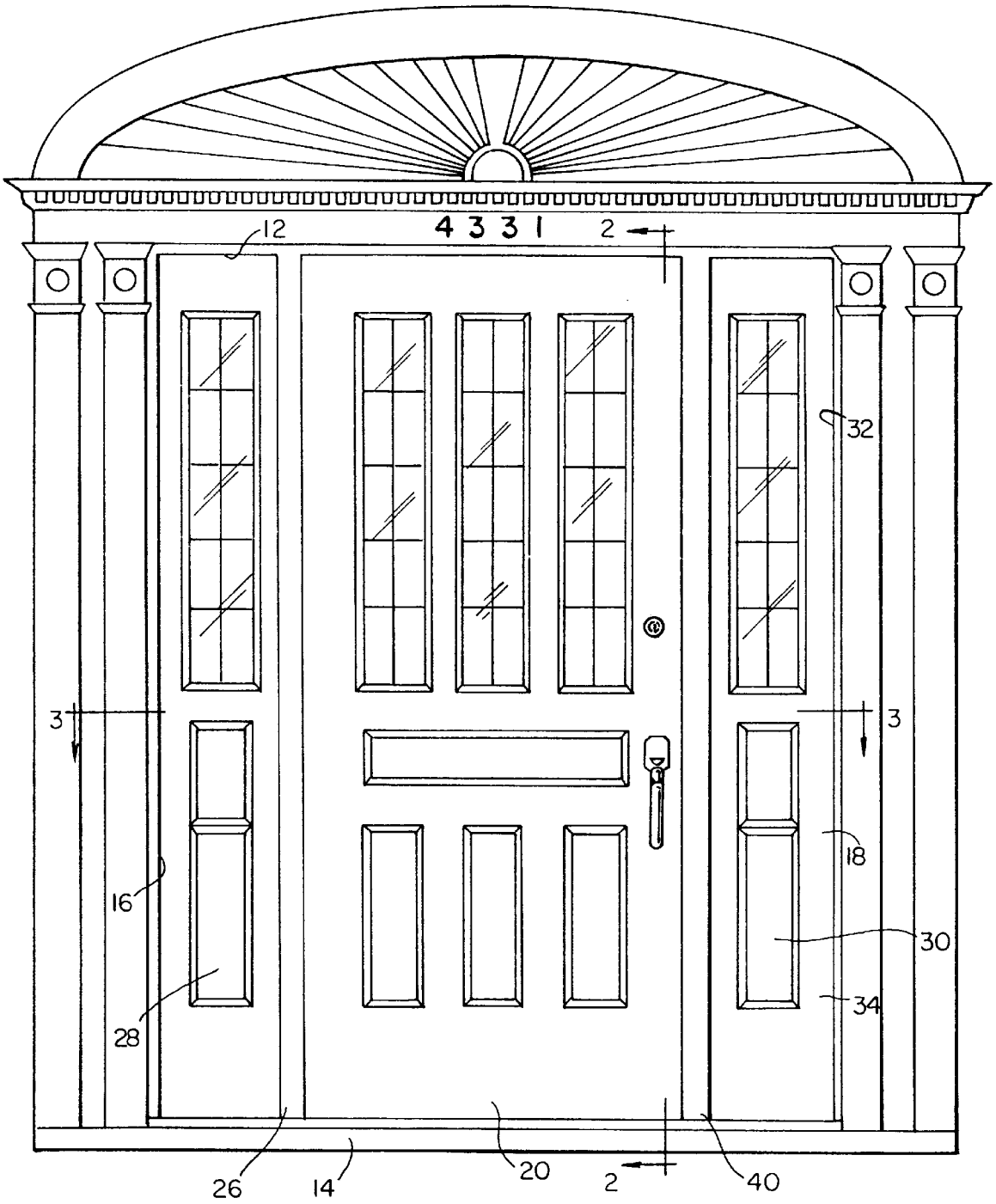
FIG. 1 is a front elevation of a an exterior door and side light panel assembly, embodying the invention.

As shown in FIG. 1, a door assembly embodying the invention comprises a frame 10 made of wood, or of metal channel stock, comprising upper and lower horizontal members 12 and 14, and vertical side members 16 and 18.

The door 20 is connected by hinges 22 to the hinge jamb 26, which is securely fixed between the upper and lower horizontal members 12 and 14. A fixed side light 28 is contained between the vertical members 16 and 26 on the left of the door. There is no fixed member on the right, corresponding to the hinge jamb 26; instead, the free edge of the door closes against the edge of the right side light 30. Although the side light 30 appears identical to the fixed left side light, it is functionally different in that it is mounted on hinges 32 to the vertical member 18, so that it, too, can swing inward.

Figure 3:
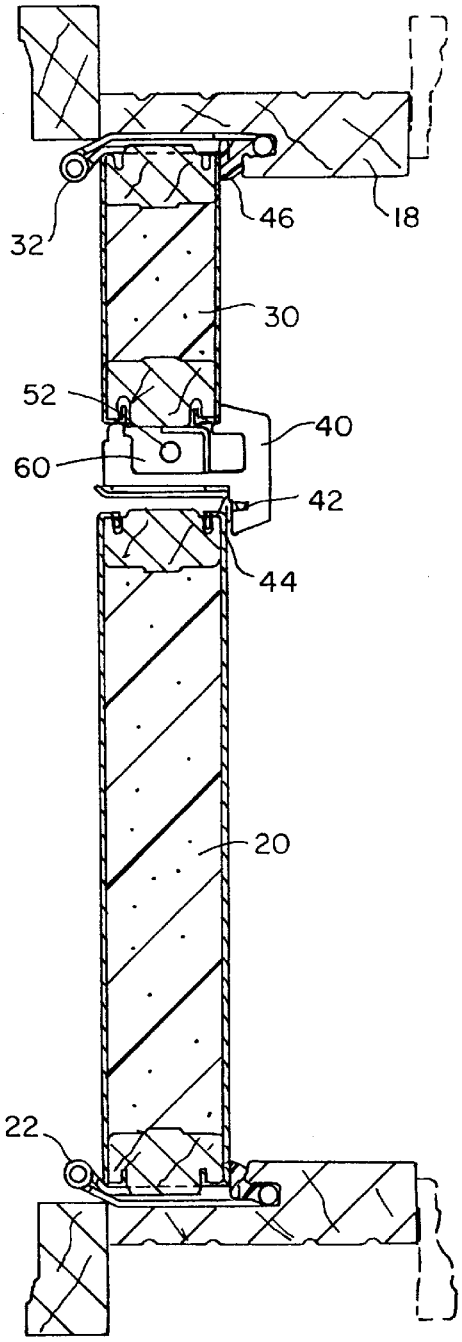
FIG. 3 is a sectional view thereof, looking downward, taken on the horizontal section plane 3–3 in FIG. 1.
Figure 4:
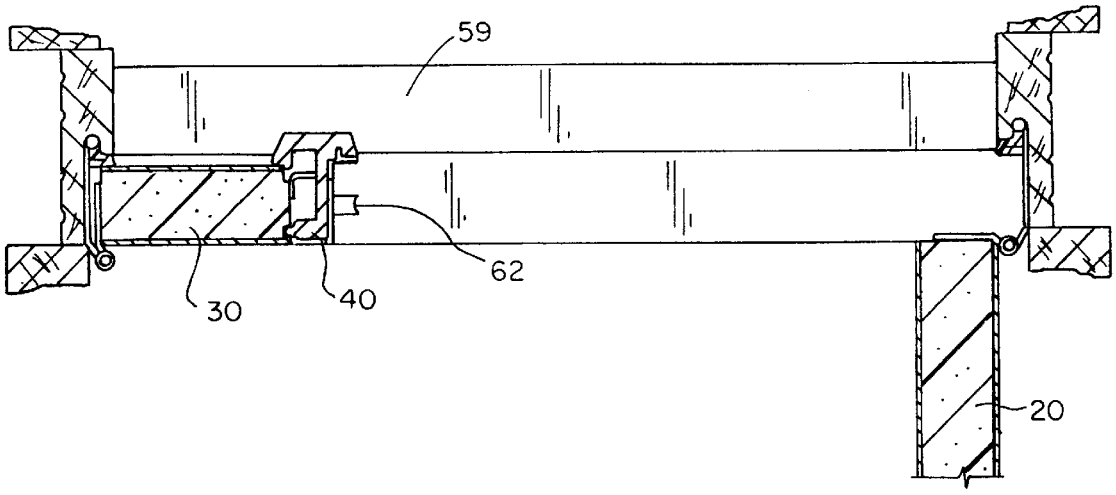
FIG. 4 is a view like FIG. 3, showing the door opened 90°.
Figure 5:
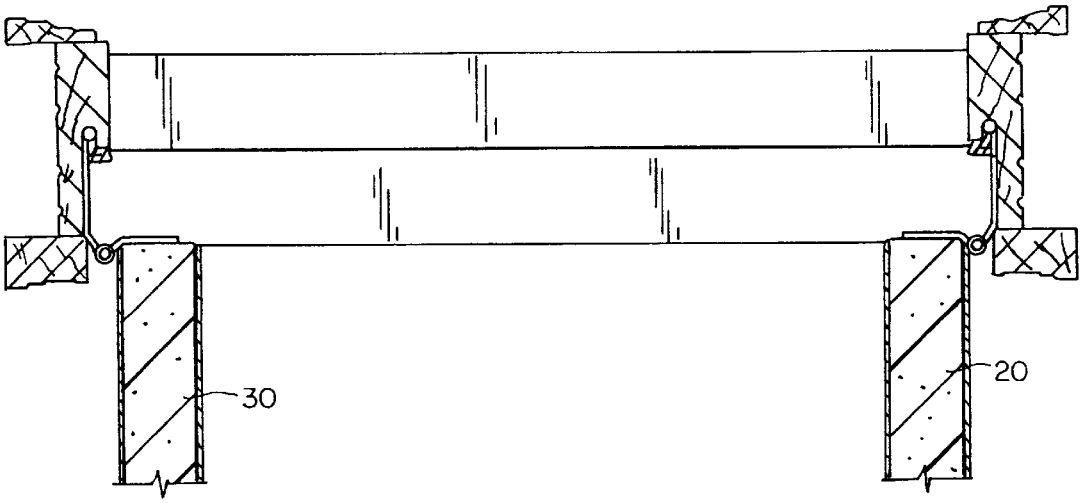
FIG. 5 is a view like FIG. 3, showing both the door and the side light opened 90°.

FIGS. 3, 4 and 5 show the door and the side light in various positions. It can be seen that the width of the door opening is substantially greater when the side light is open.

A typical side light panel width is twelve inches for a 30-inch door, or fourteen inches for a 36-inch door. The term "side light" is intended to connote panels having such width, which is well less than half the width of the main door.

Figure 2:
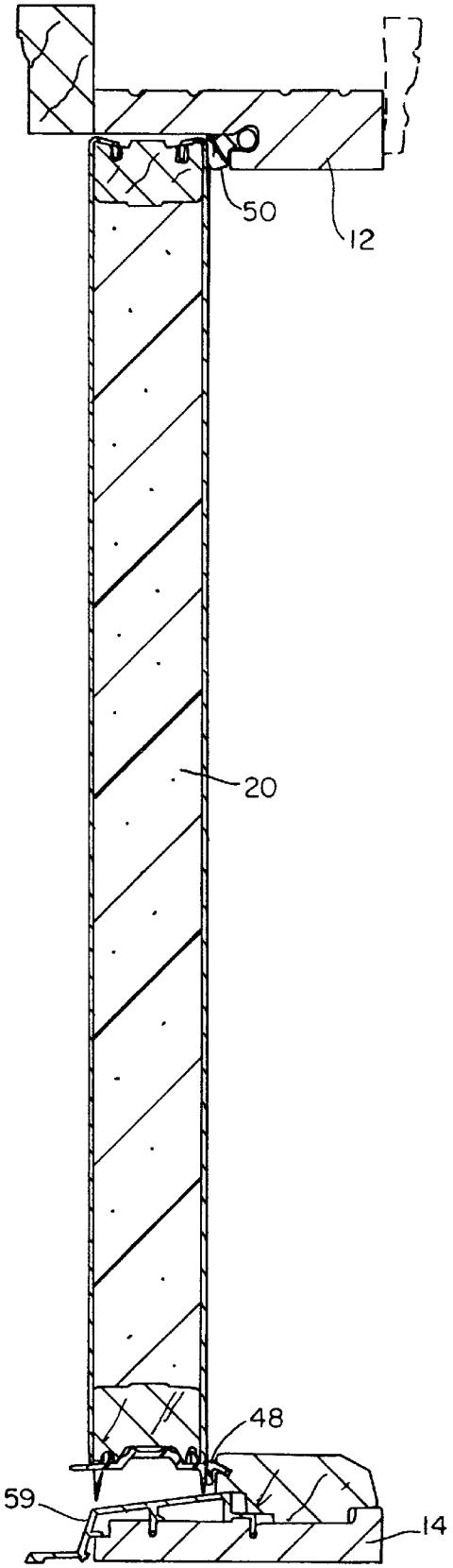
FIG. 2 is a sectional view thereof, taken on a vertical plane, looking in the direction 2–2 in FIG. 1.

As shown in FIGS. 3–5 (where the fixed side light 28 is omitted), the free edge of the side light has a vertical molding or extrusion 40 that functions as an astragal. The astragal is provided with a channel 42 to receive weatherstripping 44. The opposite edge is permanently affixed and hermetically sealed against the free edge of the side light panel. The hinged vertical edge of the side light compresses a fixed seal strip 46 as it closes. FIG. 2 shows top and bottom horizontal seals 48, 50 on the jamb. Similarly, FIG. 6 shows a top seal for the door, and a bottom seal on the bottom of the door, which engages the threshold when the door is closed.

Normally, the swingable side light is kept closed (FIG. 3) by two bolts 52, which seat in receptacles on the sill 59 and the top jamb, respectively. Each bolt slides vertically in a vertical channel 60 within the astragal; the bolt position is controlled by a respective conventional flush actuating lever 62 accessible from the free edge of the astragal. One flips the levers outward to withdraw the bolts from the receptacles, so that the side light can be opened (FIG. 4). FIG. 5 shows both the side light and the door wide open.

Except when the side light is opened, the astragal serves as a door jamb, and provides for latching and sealing of the door. The door latching hardware, being conventional, is not illustrated.

Figure 6:
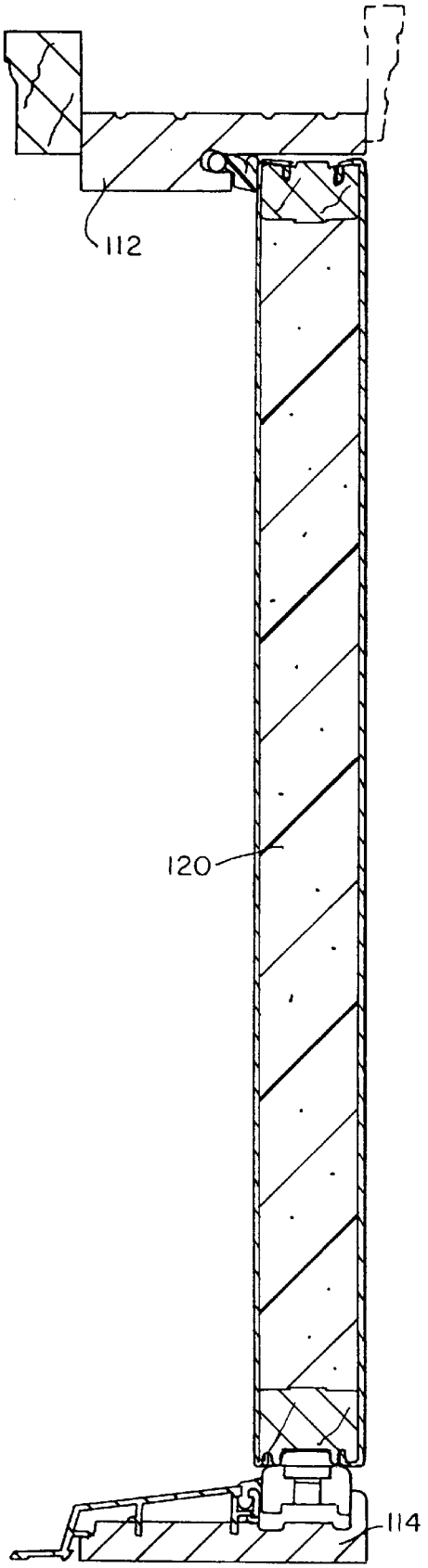
FIG. 6 is a view like FIG. 2, of a modified form of the invention, applied to an outswinging door.
Figure 7:
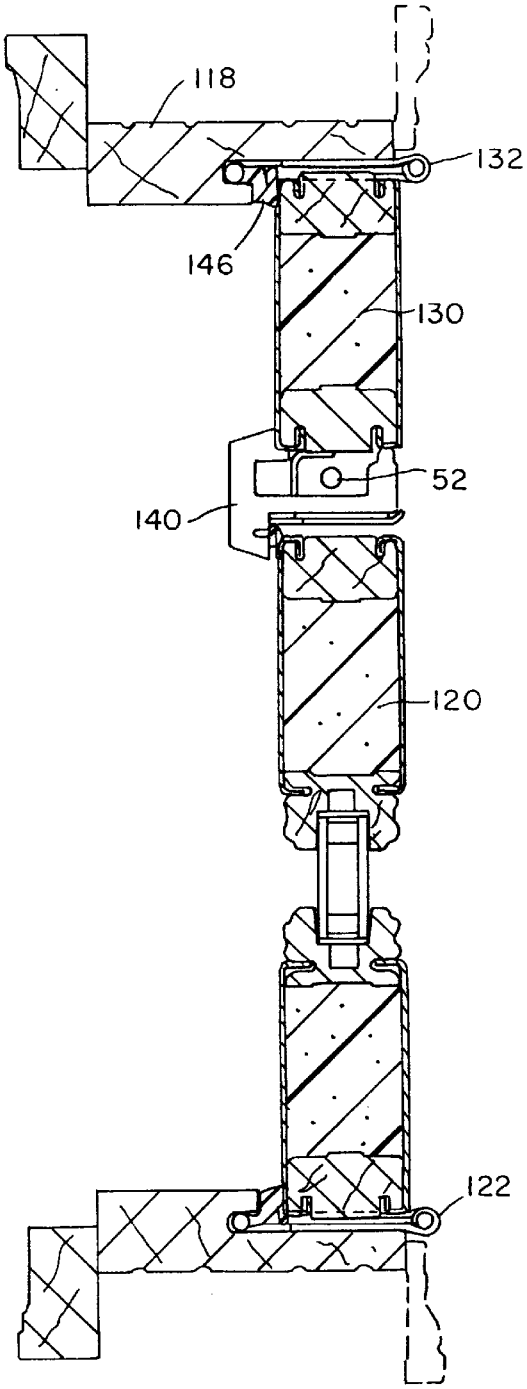
FIG. 7 is a view like FIG. 3, of the modified form of the invention.

FIGS. 6 and 7 show a modified form of the invention, where the doors swing outward, as entry doors do in certain parts of the country. Corresponding non-identical parts are indicated by reference numerals as above, plus 100. Minor differences in the sill, the seals, and the hardware may be noted, but the modification functions like the embodiment discussed first, in that the side light and door can both be opened to maximize the door opening.

Since the invention is subject to modifications and variations, it is intended that the foregoing description and the accompanying drawings shall be interpreted as only illustrative of the invention defined by the following claims.

I claim:

1. A door and side light assembly comprising a frame forming a door opening comprising a pair of vertical side members, a top jamb extending between the side members, a sill and a hinge jamb extending between the sill and the top jamb, a door having a hinged edge pivotally connected to the hinge jamb, and a free edge, a side light adjacent the door, said side light having a molding member forming an astragal against a free edge which the free edge of the door closes when the side light is closed, means for latching the door to the molding member, said side light being hinged to one of the vertical side members to swing about an edge opposite the free edge, of the side light whereby the side light may be opened to maximize the door opening when needed, and means for locking the side light closed against the frame, wherein the side light has a maximum width of fourteen inches and the side light is less than half as wide as the door.

2. The invention of claim 1, wherein the astragal is an extruded metal member having a surface against which the door closes, and comprises means for retaining weather stripping to seal between the door and said surface.

3. The invention of claim 1, further comprising a pair of sliding bolts in the side light, for engaging receptacles in the sill and the top jamb, to hold the side light closed normally.

4. The invention of claim 3, further comprising a pair of levers, each normally flush with the free edge of the astragal, which are pivotally mounted in the astragal each said lever being linked to a respective one of said sliding bolts, whereby the levers can be flipped outward to withdraw the bolts from the receptacles so that the side light can be swung open.

* * * * *